United States Patent [19]

Ching

[11] Patent Number: 4,708,379

[45] Date of Patent: Nov. 24, 1987

[54] ADJUSTABLE LATCH

[75] Inventor: Hui P. Ching, Mei Foo Sun Cheun, Hong Kong

[73] Assignee: Kambo Security Products Ltd., Kowloon, Hong Kong

[21] Appl. No.: 893,397

[22] Filed: Aug. 5, 1986

[51] Int. Cl.[4] ..... E05C 1/16

[52] U.S. Cl. ..... 292/337; 292/1; 292/DIG. 60; 292/336.3; 292/169

[58] Field of Search ..... 292/1, 337, DIG. 10, 292/336.3, 169, 169.13, 169.14, 169.15

[56] References Cited

U.S. PATENT DOCUMENTS 4,372,594 2/1983 Gater ..... 292/DIG. 44 X 4,662,665 5/1987 Lin ..... 292/337 X

*Primary Examiner*—Richard E. Moore

*Attorney, Agent, or Firm*—Charles H. Schwartz; Ellsworth R. Roston

[57] ABSTRACT

An adjustable latch for a lockset for adjusting to either of two backset positions including a first cylindrical member having a first particular diameter. A second cylindrical member has a second diameter larger than the first diameter and with the first and second cylindrical members located in a telescopic arrangement for providing a telescopic adjustment between the cylindrical members. A first detent is interconnected between the first and second cylindrical members and has two detent positions corresponding to the two backset positions. A latch is located within the first cylindrical member. An actuating member is located without the cylindrical members at a position opposite to the latch for actuating the latch between open and closed positions. A second detent interconnects the latch and the actuating member and includes two detent positions corresponding to the two backset positions. Unlocking means is coupled to both the first and second detent means to unlock both detent means to allow adjustment between the two backset positions.

22 Claims, 11 Drawing Figures

FIG. 1
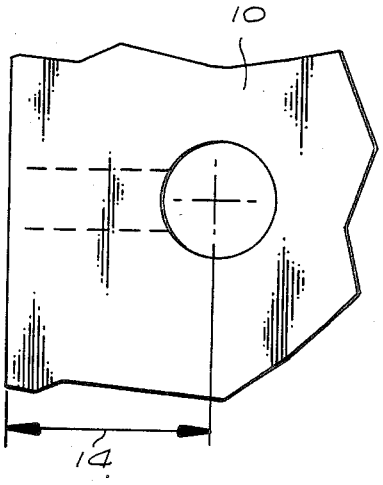
FIG. 2
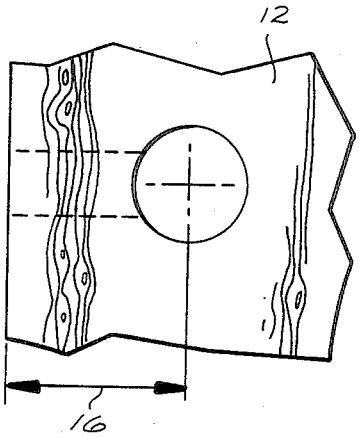
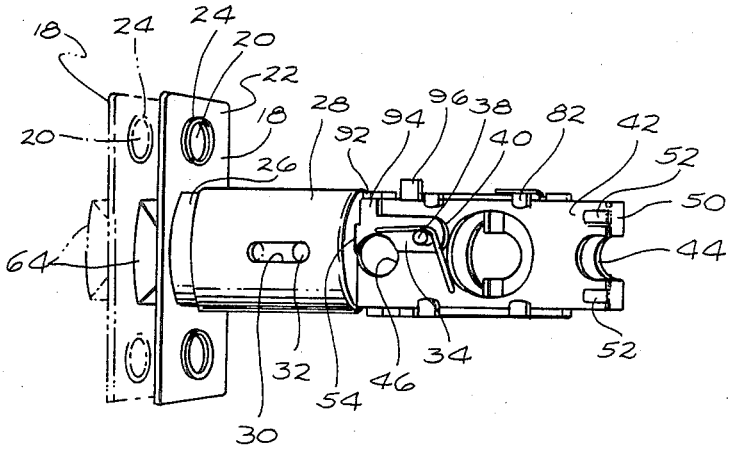
FIG. 3
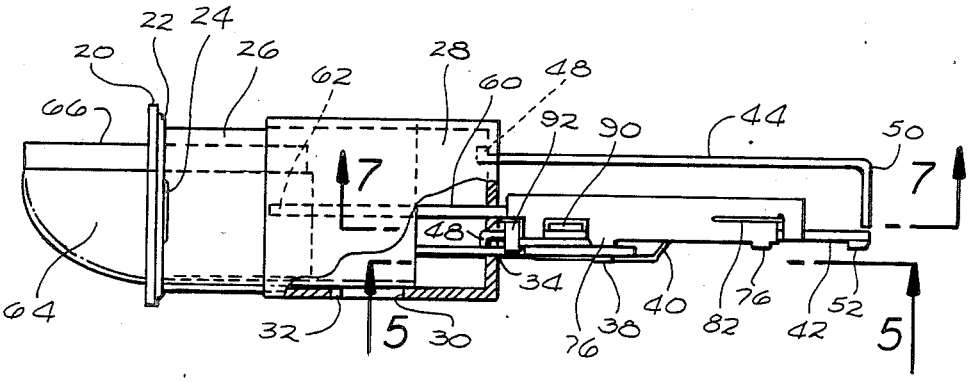
FIG. 4

FIG. 5
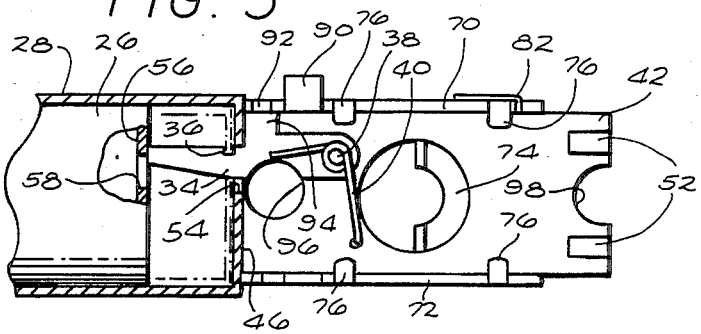
FIG. 6
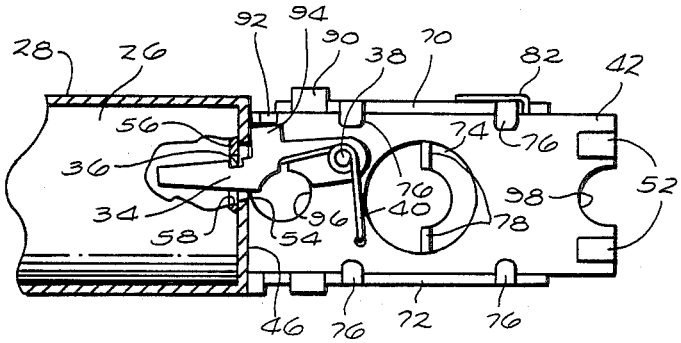
FIG. 7
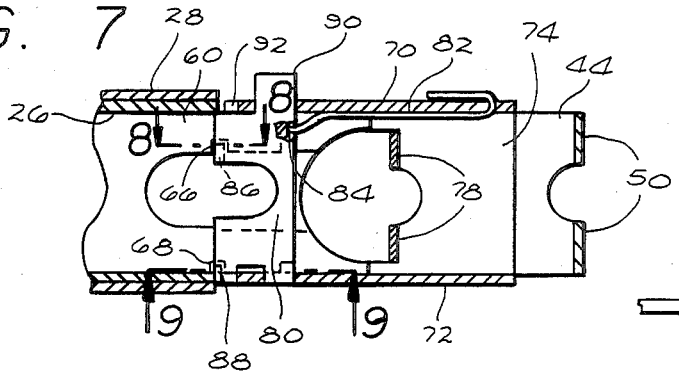
FIG. 8
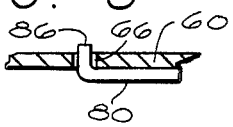
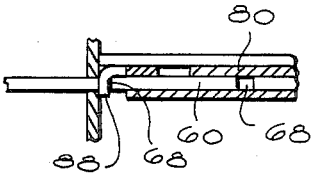
FIG. 9
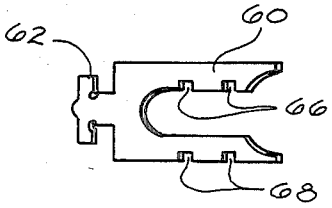
FIG. 10
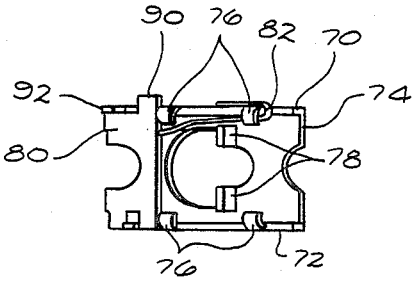
FIG. 11

ADJUSTABLE LATCH

BACKGROUND OF THE INVENTION

1. Field of the Invention

The present invention relates to an adjustable latch for use with a lockset. Specifically, the invention relates to a latch which is adjustable between a $2\frac{3}{8}''$ or $2\frac{3}{4}''$ backset.

2. Description of the Prior Art

Entry doors are typically made to accept locksets having backsets for the latch of either one of two distances. The normal wooden household door typically uses a lockset having a backset of $2\frac{3}{8}''$ for the latch. Heavy duty metal doors which may be used for commercial or industrial purposes or may be used for residential purposes typically have a lockset having a backset of $2\frac{3}{4}''$ for the latch. These metal doors are normally sold with a premade opening for a $2\frac{3}{4}''$ backset for the latch.

In the past, separate latches were used for the locksets depending upon the particular backset. Specifically, if the door required a latch having a $2\frac{3}{8}''$ backset, a latch having this dimension was used with the lock. On the other hand if the door required a latch with a $2\frac{3}{4}''$ backset, this size latch was provided even though the remaining portions of the lockset may be identical to the lockset used with the latch having the $2\frac{3}{8}''$ backset. In otherwords, the only difference between the locks for use for either the $2\frac{3}{8}''$ or $2\frac{3}{4}''$ backsets was the latch itself.

It has, therefore, been considered desirable to provide for an adjustable latch that can be used for either a $2\frac{3}{8}''$ or $2\frac{3}{4}''$ backset. This would eliminate the cost of manufacturing two separate latches and would also eliminate the necessity of stocking a double inventory for complete locksets or for latches. An adjustable latch could, therefore, greatly simplify the inventory requirement and thereby reduce the cost of stocking this double inventory.

Unfortunately, the adjustable latches provided by the prior art have been complicated in structure and cumbersome in operation. For example, prior art devices have included structures which have removable pieces which must be extracted and repositioned or removed completely. Other prior art structures include sliding members to provide for adjustability. These sliding members form an active part of the latch structure by interacting with portions of the lockset which project through the latch from opposite sides of the door. In otherwords, the lockset itself engages portions of the adjustable part of the latch so that any inaccuracies or misadjustment of the adjustable latch can create difficulties with the operation of the remaining portions of the lockset. The prior art devices do not provide for a simple, reliable, foolproof and easily operated adjustable latch.

SUMMARY OF THE INVENTION

Reference is made to co-pending application Ser. No. 884,712 filed 7/11/86 and assigned to the same assignee as the instant application. This co-pending application discloses an adjustable deadlatch of the type commonly referred to as a deadbolt. The present invention is directed to an adjustable latch not of the deadbolt type, but including a locking member to prevent the latch from being slid into the latch structure when the door is in a closed position. This is a well known feature and forms no part of the present invention.

The adjustable latch of the present invention includes a positive and simple structure for adjusting the latch between $2\frac{3}{8}''$ and $2\frac{3}{4}''$ backset positions. The adjustment is provided by a structure including a pair of detent means each having at least two detent positions corresponding to the backset positions to lock the detent means in the two different backset positions. The adjustable latch is guided between these different backset positions by a structure formed by a pin captured within a slot which structure is part of a first detent means. The pin in the slot not only operates to guide the adjustable latch between the two backset positions, but also acts as a stop for the two backset positions for the first detent means and insures that the first detent means is properly engaged at the backset positions.

The adjustable latch includes two cylindrical members which allow for longitudinal movement between the cylindrical members. The slot is formed in one of the cylindrical members and with the pin extending into the slot from the other of the cylindrical members. The first detent means also includes a first locking member which extends from an exterior position to a position within at least one of the cylindrical members. The first locking member locks onto a end wall of the one of the cylindrical members and with a portion of the end wall serving as part of the first detent means. A sliding member extends into the cylindrical members to engage a portion of the latch itself and with the sliding member forming part of the second detent means. A second locking member is provided immediately adjacent the end wall of the one of the cylindrical members to lock the sliding member with an actuating member in either of the two backset positions.

The actual adjustment of the adjustable latch of the present invention is provided by an extension of the second locking member which when moved inward releases both locking members to thereby release both detent means at the same time. The cylindrical members now may be moved longitudinally relative to each other to adjust the backset position for both the cylindrical members and also for the latch and its associated actuating member.

In order to insure that once the latch has been adjusted it cannot slip out of its position after the latch has been installed in the lockset, part of the releasing structure for the adjustment portion surrounds an opening used to interconnect the opposite sides of the lockset. If the adjustable latch is left in an intermediate position, the lockset cannot be installed since this opening would not be free and, therefore, the opposite sides of the lockset could not be connected.

The lockset is, therefore, adjusted between its two backset positions by merely pressing in the release portion of the second locking member which releases both of the detent means and allows the cylindrical members to move longitudinally relative to each other and also move the latch actuating structure between the two backset positions.

BRIEF DESCRIPTION OF THE DRAWINGS

A clearer understanding of the present invention will be had with reference to the following descriptions and drawings wherein.

FIG. 1 illustrates an entry door having a first backset location for a latch;

FIG. 2 illustrates an entry door having a second backset position for a latch;

FIG. 3 is a perspective view of an adjustable latch constructed in accordance with the teachings of the present invention which latch may be used with either of the entry doors shown in FIGS. 1 or 2;

FIG. 4 is a top view of the latch of FIG. 3;

FIG. 5 is a cross-sectional view taken along lines 5—5 of FIG. 4;

FIG. 6 is a cross-sectional view taken along lines 5—5 of FIG. 4 and with the detent means released for adjustment of the latch between the backset positions;

FIG. 7 is a cross-sectional view taken along lines 7—7 of FIG. 4;

FIG. 8 is a cross-sectional view taken along lines 8—8 of FIG. 7;

FIG. 9 is a cross-sectional view taken along lines 9—9 of FIG. 7;

FIG. 10 is a detailed view of a sliding member; and

FIG. 11 is an assembly view of a locking member and an actuating member forming a portion of the latch of the present invention.

DESCRIPTION OF THE PREFERRED EMBODIMENT

As shown in FIGS. 1 and 2, entry doors 10 and 12 are shown to have different backsets. It is to be appreciated that the term entry door is used to indicate a door leading from the outside to the inside of the building. This is the type of door that normally would use a latchbolt with an automatic locking feature as shown in the present application. However, it is to be appreciated that the invention may be used with any type of door, whether exterior or interior.

As shown in FIGS. 1 and 2 the backset, represented by arrow 14 in FIG. 1 and arrow 16 in FIG. 2, has different distances. This is because heavier metal doors, such as shown in FIG. 1, typically have a backset of $2\frac{3}{4}''$. On the other hand, wooden doors such as the door shown in FIG. 2, typically have a backset of $2\frac{3}{8}''$.

In order to accommodate the different backsets, either separate length latches must be used with locksets when the lockset is to be installed on doors with different backsets, or an adjustable latch must be used so that the locksets can accommodate doors with different backsets.

FIGS. 3 through 11 illustrate a specific embodiment of an adjustable latch construct in accordance with the teachings of the present invention which latch may be used with a lockset to accommodate the two different backset positions shown in FIGS. 1 and 2. These two different backset distances are respectively $2\frac{3}{4}''$ for the backset position with the door of FIG. 1 and $2\frac{3}{8}''$ for the backset position for the door of FIG. 2.

The adjustable latch of the present invention includes a face plate 18 which has openings 20 for receiving screws to lock the latch to the edge of the door. Attached to the faceplate 18 is a backplate 22 which is attached by integral rivets 24. Specifically the rivets 24 are formed as an extension of the material around the openings 20. The rivets pass through complementary openings in the backplate 22 and are riveted over to lock the frontplate and backplate together.

Extending from the backplate 22 is a cylindrical member 26. The cylindrical member 26 fits within a complementary cylindrical member 28 in a telescopic fashion. Specifically the cylindrical members 26 and 28 may be moved longitudinally relative to each other. This movement is guided by a slot 30 located in the cylindrical member 28 and a pin 32 which extends into the slot 30 and is supported by the cylindrical member 26. The length of the slot 30 is equal to the distance between the two backset positions of $2\frac{3}{8}''$ and $2\frac{3}{4}''$. The slot 30 thereby acts not only as a guide for the longitudinal movement of the cylindrical members relative to each other, but also forms a portion of a first detent means and acts as a stop for the two backset positions.

The actual locking of the latch in the two backset positions is accomplished by two detent means which can be locked into detent positions representing the backset positions. Specifically, a first detent means includes a first locking member 34 which includes a notch 36. The locking member 34 is pivotable about a post member 38 and a spring 40 tends to maintain the locking member 34 biased in a clockwise direction as viewed in FIGS. 3, 4, 5 and 6.

The locking member 34 is mounted on one of a pair of support arms 42 and 44 which extend backward from the cylindrical member 28. The support arms 42 and 44 may be permanently attached to an end wall portion 46 of the cylindrical member 28 and in particular may be affixed by bent portions 48 as shown in FIG. 4. The opposite end 50 of the arm member 44 is bent over at a right angle and is attached to the member 42 by bends 52. This forms a rigid open box for receiving and supporting a sliding actuator portion of the latch mechanism.

As can be seen in the drawings, the post 38 extends outward from the arm member 42 to support the locking member 34 at a position on the outside of the arm member 42. The locking member 34 passes through an opening 54 in the end wall 46 of the cylindrical member 28. As can be seen in FIG. 5, the locking member 34 passes through the opening 54 and serves as a stop against an end wall portion 56 of the cylindrical member 26 for a first backset position. The end wall member 56 also includes an opening 58 which may receive the locking member 34 in a second backset position. As shown in dotted line in FIG. 5, when the cylindrical members 26 and 28 are telescoped together a portion of the end wall 56 may be locked in the groove 36 of the member 34.

As can be seen in FIG. 6 the locking member 34 may be released from its locked position by rotating downward to unlock the end wall 56 from the groove 36. At this time, the two cylindrical members 26 and 28 may be moved relative to each other as the end portion of the member 36 passes through the opening 58. The combination of the pin 32 and slot 30 and locking member 34 and end wall 56 forms the first detent means. For the $2\frac{3}{4}''$ backset position the cylindrical members are locked in position by the combination of the end of the member 34 against the wall 56 to serve as a stop in one direction while the pin 32 at one end of the slot 30 serves as a stop in the other direction. For the $2\frac{3}{8}''$ backset position, the cylindrical members are locked in position by the portion of the end wall locked in the groove.

A second detent means includes a sliding member 60 shown in FIG. 10. The member 60 includes an end portion 62 which is coupled to a door latch 64 as shown in FIG. 4. The latching structure also includes a locking member 66 to lock the latch 64 in position when the door is closed. This portion of the latch structure plus the specific attachment of the member 60 through the use of the end portion 62 to the latch 64 is conventional and forms no part of the present invention. The member 60, however, does include sets of slots 66 and 68 which do provide for two adjustment positions for the different backsets. This portion of the member 60 does form a significant part of the present invention.

The member 60 extends from the latch 64 and extends through the end wall 56 of the cylindrical member 26. Further, the member 60 extends through the end wall 46 of the cylindrical member 28 and is then received for sliding movement within extending wall portions 70 and 72 of an actuator member 74. The actuator member 74 provides for the innerconnection between the lockset and the latch 64 and movement of the actuator member by rotating of the lockset provides for retraction of the latch 64. The actuator member 74 is mounted between the support arms 42 and 44 and slides against the support arm 42. Specifically a series of bent portions 76 act as guides to hold the actuator member 74 loosely against the support arm 42 for sliding movement.

The member 60 is located intermediate the space formed by the actuator member 76 and the support arm 42. A pair of bent portions 78 project outward from the actuator member 74 to insure that there is proper spacing between the actuator member and the arm member 42 so that during sliding movement of the actuator member 74 the actuator member does not bind by twisting.

A second locking member 80 is also located between the actuator member 74 and the support arm 42. Specifically the locking member 80 overlays the member 60 and provides for locking of the member 60 relative to the actuator member 74 in either one of the two backset positions. In addition the locking member 80 also is used to provide for unlocking both of itself and of the first locking member 34.

The locking member 80 is spring biased in an upward direction, as shown in FIG. 7, by a spring member 82 which is bent around a portion of the wall 70 and also extends into an opening 84 within the locking member 80. The locking member 80 includes finger portions 86 and 88 which can be received in the slots 66 and 68 of the member 60. The distance between each set of slots 66 and 68 represent the two different backset positions. It can be seen, therefore, that the locking member, through the use of the fingers 86 and 88 locked within the slots 66 or 68, provides a second detent means for locking the member 60 to the actuator member 74 in either of the two backset positions.

The locking member 80 also includes an upstanding portion 90 which upstanding portion extends pass the actuating member 74 and the support arm 42. The upstanding portion 90 may, therefore, be pushed downward to release the locking member 80 from the member 60. The locking member 80 also includes a bent arm portion 92 which passes over an upstanding portion 94 of the first locking member 34. When the upstanding portion 90 is pressed downward, the arm portion 92 also presses down against the upstanding portion 94 to rotate the locking member 34 out of engagement. In this way a single actuation of the locking member 80 through the depression of the upstanding portion 90 provides for a release of both detent means so that the cylindrical members 26 and 28 and the members 60 and 74 may be slid relative to each other to lock the latch in either of the backset positions.

As shown in the drawings, the latch of the present invention also includes openings 96 and 98. These openings are used to pass portions of the lockset so that the opposite sides of the lockset on either side of the door may be coupled together. As can be seen in FIG. 6, when the locking member 80 is moved downward which in turn provides for downward movement of the locking member 34, a portion of the member 34 obstructs the opening 96. In this way if the latch has not been properly locked in one of the two backset positions, the two halves of the lockset cannot be properly coupled together. This prevents an improper installation of the adjustable latch by preventing the coupling together of the two halves of the lockset. Also, once the lockset has been installed, the locking member 34 is blocked from rotary movement thereby preventing unlocking of the detent means.

The present invention, therefore, provides for an adjustable latch having one of two possible backset positions including a pair of cylindrical members guided to move between the two backset positions through the use of a pin riding in a slot. In order to lock the latch in the two positions, a pair of detents are used with the first detent coupled between the pair of cylindrical members and the second detent coupled between an actuating member and the latch itself to adjust the distance between the actuating member and the latch. The second detent includes a member which slides relative to the actuating member and with a locking member locking the sliding member in one of the two backset positions.

The first detent is used to lock the two cylindrical members relative to each each other in the two backset positions. The first detent includes a pin in a slot to provide for the guiding between the two cylindrical members and with a different locking member locking the cylindrical members in the two backset positioning once the latch has been placed in either of the two backset positions. The second detent means, which forms part of the interconnection between the latch and the actuator, can slide freely relative to the cylindrical members which have been locked together by the first detent means. Both detent means are controlled between their two backset positions through the use of a common unlocking means to unlock the detents so that the latch may be adjusted to the backset positions.

Although the invention has been described with reference to a particular embodiment, it is to be appreciated that various adaptations and modifications may be made and the invention is only to be limited by the appended claims.

I claim:

1. An adjustable latch for a lockset for adjusting to either of two backset positions for the lockset, including a first cylindrical member having a first particular diameter, a second cylindrical member having a second diameter larger than the first diameter and with the first and second cylindrical members located in a telescopic arrangement for providing a telescopic adjustment between the cylindrical members, a first detent means interconnected between the first and second cylindrical members and having two detent positions corresponding to the two backset positions for telescopic positioning of the cylindrical members in the two detent positions, a latch located within the first cylindrical member, an actuating member located without the cylindrical members at a position opposite to the latch for actuating the latch between open and closed positions, a second detent means formed as a sliding member interconnecting the latch and the actuating member and including two detent positions corresponding to the two backset positions for locking the sliding member to the actuating member in either of the two detent positions, and unlocking means coupled to both the first and second detent means for unlocking both detent means to allow adjustment between the two backset positions.

2. The adjustable latch of claim 1 wherein the first detent means includes a slot in one of the cylindrical members and a pin extending into the slot from the other of the cylindrical members and with the distance travelled by the pin when in opposite end positions in the slot substantually equal to the distance between the two backset positions.

3. The adjustable latch of claim 2 wherein the first detent means includes a first locking member for locking the pin in the slot at either of the opposite end positions.

4. The adjustable latch of claim 3 wherein the first locking member extends through an end wall portion of one of the cylindrical members to be locked to an end wall portion of the other of the cylindrical members.

5. The adjustable latch of claim 4 wherein the first locking member is mounted for rotary movement for locking and unlocking to the end wall portion and additionally including a spring member coupled to the first locking member to spring bias the first locking member to the locked position.

6. The adjustable latch of claim 1 wherein the sliding member of the second detent means includes at least two slots spaced apart a distance substantially equal to the distance between the two backset positions and with the sliding member locked to the actuating member through either of the two slots.

7. The adjustable latch of claim 6 wherein the second detent means additionally includes a second locking member coupled to the actuating member and with the second locking member including an arm portion for reception in either of the slots for locking the sliding member to the actuating member in either of the backset positions.

8. The adjustable latch of claim 7 wherein the second locking member is mounted for sliding movement relative to the actuating member and with the sliding movement of the second locking member perpendicular to sliding movement of the sliding member relative to the actuating member and additionally including a spring member coupled to the second locking member to spring bias the second locking member to the locked position.

9. The adjustable latch of claim 1 wherein the first detent means includes a first locking member for locking the first detent means in either of the backset positions and the second detent means includes a second locking member for locking the second detent means in either of the backset positions and wherein the unlocking means is coupled to both the first and second locking members.

10. The adjustable latch of claim 9 wherein the unlocking means is formed as integral extensions of one of the locking members.

11. The adjustable latch of claim 10 wherein the unlocking means is formed as integral extensions of the second locking member.

12. An adjustable latch for a lockset for adjusting to either of two backset positions, including a first cylindrical member having a first diameter, a second cylindrical member having a second diameter larger than the first diameter and with the first and second cylindrical members located in a telescopic arrangement for providing a telescopic adjustment between the cylindrical members, a first detent means interconnected between the first and second cylindrical members and having two detent positions corresponding to the two backset positions for telescopic positioning of the cylindrical members in the two detent positions and including a slot in one of the cylindrical members and a pin extending into the slot from the other of the cylindrical members, a latch located within the first cylindrical member, an actuating member located without the cylindrical members at a position opposite to the latch for actuating the latch between open and closed positions, a second detent means interconnecting the latch and the actuating member and including two detent positions corresponding to the two backset positions, and unlocking means coupled to both the first and second detent means for unlocking both detent means to allow adjustment between the two backset positions.

13. The adjustable latch of claim 12 wherein the distance travelled by the pin when in opposite end positions in the slot is substantually equal to the distance between the two backset positions.

14. The adjustable latch of claim 12 wherein the first detent means includes a first locking member for locking the pin in the slot at either of the opposite end positions.

15. The adjustable latch of claim 14 wherein the first locking member extends through an end wall portion of one of the cylindrical members to be locked to an end wall portion of the other of the cylindrical members.

16. The adjustable latch of claim 15 wherein the first locking member is mounted for rotary movement for locking and unlocking to the end wall portion and additionally including a spring member coupled to the first locking member to spring bias the first locking member to the locked position.

17. The adjustable latch of claim 12 wherein the sliding member of the second detent means includes a sliding member having at least two slots spaced apart a distance substantially equal to the distance between the two backset positions and with the sliding member locked to the actuating member through either of the two slots.

18. The adjustable latch of claim 17 wherein the second detent means additionally includes a second locking member coupled to the actuating member and with the second locking member including an arm portion for reception in either of the slots for locking the sliding member to the actuating member in either of the backset positions.

19. The adjustable latch of claim 18 wherein the second locking member is mounted for sliding movement relative to the actuating member and with the sliding movement of the second locking member perpendicular to sliding movement of the sliding member relative to the actuating member and additionally including a spring member coupled to the second locking member to spring bias the second locking member to the locked position.

20. The adjustable latch of claim 12 wherein the first detent means includes a first locking member for locking the first detent means in either of the backset positions and the second detent means includes a second locking member for locking the second detent means in either of the backset positions and wherein the unlocking means is coupled to both the first and second locking members.

21. The adjustable latch of claim 20 wherein the unlocking means is formed as integral extensions of one of the locking members.

22. The adjustable latch of claim 21 wherein the unlocking means is formed as integral extensions of the second locking member.

* * * * *